US010369422B2

(12) United States Patent
Yamanaka et al.

(10) Patent No.: US 10,369,422 B2
(45) Date of Patent: Aug. 6, 2019

(54) BADMINTON RACKET

(71) Applicant: YONEX CO., LTD., Tokyo (JP)

(72) Inventors: Yosuke Yamanaka, Tokyo (JP); Kazuya Otani, Niigata (JP); Taketoshi Goto, Niigata (JP)

(73) Assignee: YONEX CO., LTD., Tokyo (JP)

( * ) Notice: Subject to any disclaimer, the term of this patent is extended or adjusted under 35 U.S.C. 154(b) by 0 days.

(21) Appl. No.: 15/577,982

(22) PCT Filed: Jun. 2, 2016

(86) PCT No.: PCT/JP2016/066466
§ 371 (c)(1),
(2) Date: Nov. 29, 2017

(87) PCT Pub. No.: WO2016/195035
PCT Pub. Date: Dec. 8, 2016

(65) Prior Publication Data

US 2018/0290026 A1 Oct. 11, 2018

(30) Foreign Application Priority Data

Jun. 5, 2015 (JP) ..... 2015-114811

(51) Int. Cl.
*A63B 49/02* (2015.01)
*A63B 60/10* (2015.01)
*A63B 102/04* (2015.01)
*A63B 71/06* (2006.01)

(52) U.S. Cl.
CPC ..... *A63B 49/02* (2013.01); *A63B 60/10* (2015.10); *A63B 2071/0694* (2013.01); *A63B 2102/04* (2015.10); *A63B 2209/02* (2013.01)

(58) Field of Classification Search
CPC ..... A63B 49/00; A63B 49/02; A63B 60/10; A63B 2102/04; A63B 2209/02
See application file for complete search history.

(56) References Cited

U.S. PATENT DOCUMENTS 4,194,738 A 3/1980 Inoue et al.
4,326,714 A 4/1982 Novack
(Continued)

FOREIGN PATENT DOCUMENTS

CN 201969291 9/2011
CN 107921313 A * 4/2018 ..... A63B 49/02
(Continued)

OTHER PUBLICATIONS

Official Communication issued in International Bureau of WIPO Patent Application No. PCT/JP2016/066466, dated Aug. 16, 2016 , along with an english translation thereof.
(Continued)

*Primary Examiner* — Raleigh W Chiu
(74) *Attorney, Agent, or Firm* — Greenblum & Bernstein, P.L.C.

(57) ABSTRACT

An object is to provide a badminton racket capable of easily achieving different performance properties on both sides of the hitting surface easily. A racket includes a frame which extends annularly, a grip, and a string which is stretched across the frame to form a hitting surface on both sides of the frame. The frame is formed to make the front surface portion and the back surface portion thereof asymmetrical in shape in a cross sectional view taken along a plane orthogonal to the extension direction of the frame. The formation of the frame into such an asymmetrical shape makes it possible to change performance properties on shuttlecock hitting between the front and back sides of the hitting surface at the time of hitting the shuttlecock, thus making it possible for the player to obtain two difference capabilities with the single racket simply by changing his or her grip.

10 Claims, 11 Drawing Sheets

(56) References Cited

U.S. PATENT DOCUMENTS

| | | | | |
|---|---|---|---|---|
| 5,226,651 | A * | 7/1993 | du Gardin | A63B 49/02 473/521 |
| 2007/0123377 | A1 | 5/2007 | Gazzara et al. | |
| 2008/0058131 | A1 | 3/2008 | Gazzara et al. | |
| 2013/0172134 | A1* | 7/2013 | Yamamoto | A63B 49/02 473/537 |
| 2014/0100063 | A1* | 4/2014 | Mace | A63B 67/18 473/524 |
| 2014/0256480 | A1* | 9/2014 | Ogawa | A63B 51/00 473/543 |
| 2015/0352411 | A1* | 12/2015 | Goto | A63B 51/12 473/534 |
| 2018/0290026 | A1* | 10/2018 | Yamanaka | A63B 49/02 |
| 2018/0290027 | A1* | 10/2018 | Yamanaka | A63B 49/02 |

FOREIGN PATENT DOCUMENTS

| | | | |
|---|---|---|---|
| JP | 54-12930 | 1/1979 | |
| JP | 60-25660 | 2/1985 | |
| JP | 62-9472 | 1/1987 | |
| JP | 4-20369 | 2/1992 | |
| JP | 4-22980 | 2/1992 | |
| JP | 8-280846 | 10/1996 | |
| JP | 2007-144187 | 6/2007 | |
| JP | 2015-8890 | 1/2015 | |
| WO | WO 2016195035 A1 * | 12/2016 | A63B 49/02 |

OTHER PUBLICATIONS

Extended European Search Report in EPO 16803469.2, dated Jan. 30, 2019.

* cited by examiner

BADMINTON RACKET

TECHNICAL FIELD

The present invention relates to a racket capable of hitting a shuttlecock with a hitting surface at either side of the racket.

BACKGROUND ART

In badminton, players play the game by hitting a shuttlecock by swinging racket. The racket is provided with a frame formed in a loop shape, and strings are stretched across the inside of the frame to form the hitting surface (face) of the racket (see Patent Literature 1).

In badminton play, both sides of the hitting surface are used to hit the shuttlecock. The reason for this is that the front and back sides of the hitting surface are reversed when the player switches between forehand and backhand or when the player changes his or her grip as needed.

CITATION LIST

Patent Literature

Patent Literature 1: Japanese Unexamined Patent Publication No. 2015-8890

SUMMARY OF THE INVENTION

Technical Problem

The frames of conventional badminton rackets are formed so that the front and back sides become symmetrical in shape as shown in the cross sectional views of FIGS. 3 through 9 in Patent Literature 1. Accordingly, various performance properties of the racket on shuttlecock hitting (e.g., shuttlecock hold, repulsion, etc.) are identical on both sides of the hitting surface.

On the other hand, preferences for the aforementioned performance properties differ among different players according to age, sex, skill level, etc., and even for the same player, depending on the changing season, his or her physical condition, etc. Accordingly, to meet a variety of tastes and preferences, there has conventionally been a problem that the burden of preparing rackets with different performance properties according to the player's preferences arises.

The present invention has been made in view of the actual situation as described above, and an object of the present invention is to provide a badminton racket capable of easily achieving different performance properties.

Solution to Problem

A badminton racket according to the present invention is characterized in that it includes a frame which extends annularly, a grip, a shaft which connects the frame and the grip to each other, and a string which is stretched across the frame to form a hitting surface on both sides of the frame, and that the frame is formed to make a front surface portion and a back surface portion thereof asymmetrical in shape in a cross sectional view taken along a plane orthogonal to an extension direction of the frame.

According to this structure, the front surface portion and the back surface portion are asymmetrical in cross sectional shape, thus being mutually different in cross sectional shape, which makes it possible to change, between the front and back sides of the hitting surface, performance properties of the racket on shuttlecock hitting at the time of hitting the shuttlecock. This allows the player to make full use of two difference capabilities easily with the single racket simply by changing his or her grip.

In the present invention, it is desirable that a through-hole into which the string is inserted be formed in the frame, and that the front surface portion and the back surface portion be mutually different in protruding amount in the frontward/backward direction with respect to the position of the central axis of the insertion hole.

Additionally, in the present invention, it is desirable that one of the front surface portion and the back surface portion include a flat surface portion substantially parallel to an in-plane direction of the hitting surface, and that the other of the front surface portion and the back surface portion include a curved surface portion which bulges in the frontward/backward direction. The term "flat surface portion" as used herein means to include a portion having the shape of a curved surface with an extremely small curvature compared with the curved surface portion. Forming the frame so that the front surface portion and the back surface portion thereof do not become identical in cross sectional shape as described above even when the racket is flipped from front to back and vice-versa makes various designs on performance on shuttlecock hitting possible.

Additionally, in the present invention, it is desirable that the frame include a front-surface forming body which forms the front surface portion and a back-surface forming body which forms the back surface portion, and that one of the front-surface forming body and the back-surface forming body be formed to include a material different from a material of the other of the front-surface forming body and the back-surface forming body. According to this configuration, the difference in material between the front and back sides also makes it possible to change performance properties of the racket on shuttlecock hitting between the front and back sides, enhance the same performance and increase the number of variations thereon.

Additionally, in the present invention, it is desirable that at least one of the frame and the shaft include a first colored portion and a second colored portion for distinguishing between the front and back sides of the hitting surface, that the first colored portion appear visible while the second colored portion be hidden from view as the badminton racket is viewed from a certain angle in a direction nonparallel and non-orthogonal to the hitting surface, and that flipping the hitting surface from this state cause the second colored portion to appear visible and cause the first colored portion to be hidden from view. According to this configuration, the player can easily distinguish between the front and back sides of the hitting surface depending on whether the first colored portions or the second colored portions is visible, which makes it possible to easily determine as to whether either the front or back sides of the hitting surface should be selected to hit the shuttlecock.

Advantageous Effects of the Invention

According to the invention, it is possible to achieve different performance properties on both sides of the hitting surface easily because the front surface portion and the back surface portion of the frame are asymmetrical in cross sectional shape.

BRIEF DESCRIPTION OF DRAWINGS

FIG. 1A is a back elevational view of the racket and FIG. 1B is a side elevational view of the racket.

DESCRIPTION OF EMBODIMENTS

Figure 1A:
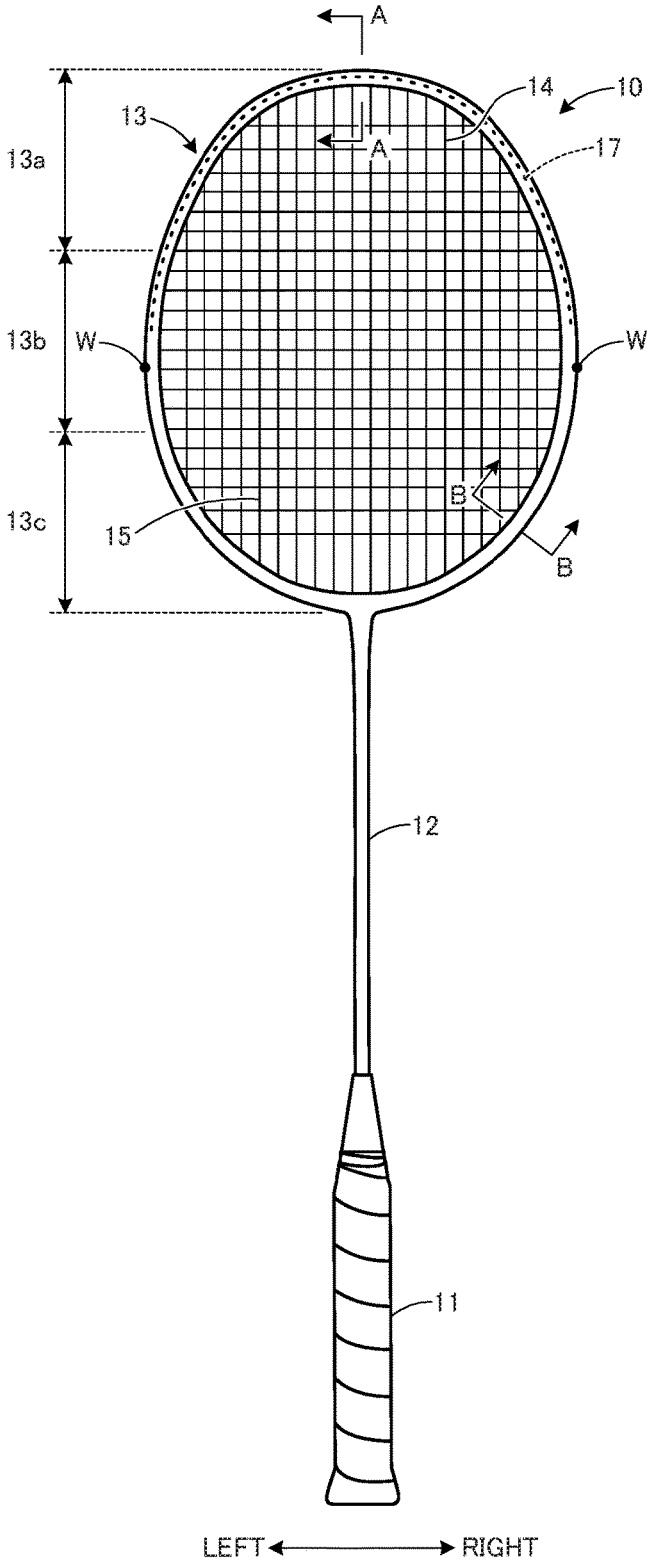
FIGS. 1A and 1B show external views of a racket according to an embodiment of the present invention.
Figure 1B:
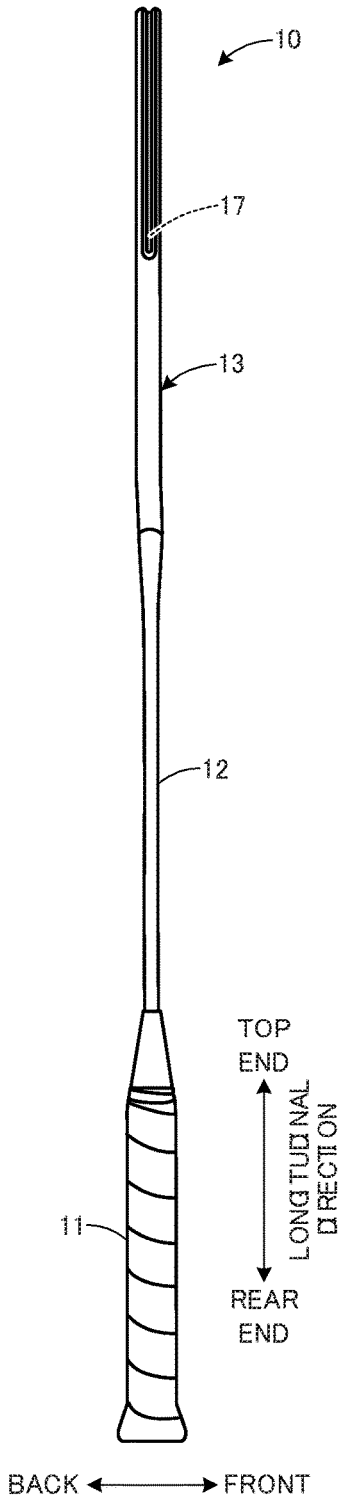

Embodiments according to the present invention will be hereinafter discussed in detail with reference to the accompanying drawings. FIG. 1 shows external views of a badminton racket according to an embodiment of the present invention; FIG. 1A is a back elevational view of the badminton racket and FIG. 1B is a side elevational view of the badminton racket. In each drawing noted below, the structure is not partially shown for the purpose of illustration.

As shown in FIG. 1, a badminton racket (referred to as "racket" in the following descriptions) 10 is provided with a grip 11, a tubular shaft 12 and an elliptical-shaped annular frame 13. The grip 11 is held by a player. The tubular shaft 12 is connected at one end to the grip 11 and extends in a linear direction. The frame 13 is connected to the other end of the shaft 12. The frame 13 is strung with a string 14 which is stretched across the inside of the frame 13 to form a hitting surface 15. Coloration, etc. are applied to the shaft 12 and the frame 13; however, such coloration, etc. will be discussed later.

In the descriptions of the claims and the specification herein, the side where the frame 13 is located and the side where the grip 11 is located in the longitudinal direction of the racket 10 are referred to as a top-end side and a rear-end side, respectively, as shown by an arrow in FIG. 1, unless otherwise noted. In addition, the direction orthogonal to the hitting surface 15 is referred to as a frontward/backward direction, the front side of the sheet of paper with respect to FIG. 1A (the left-hand side of the sheet of paper with respect to FIG. 1B) is referred to as a back side, and the opposite side of the same is referred to as a front side. Further, the direction orthogonal to the longitudinal direction on the hitting surface 15 (i.e., on a plane along the hitting surface 15) is referred to as a leftward/rightward direction, and the left side and the right side are described with reference to the state where the racket 10 is viewed with the back side facing forward as shown in FIG. 1A.

The hitting surface 15, which is formed by the string 14, is formed on both sides: the front and back sides. In badminton play, all strokes are usually made either forehand or backhand; it is usually the case that the player hits the shuttlecock forehand when the shuttlecock comes to the side of the hand gripping the racket 10 and that the player hits the shuttlecock backhand when the shuttlecock comes to the side opposite to the side of the hand gripping the racket 10. In addition, the front and back sides of the hitting surface 15, which hits the shuttlecock, are reversed between forehand and backhand due to the nature of the badminton swing.

The frame 13 is provided with a top portion 13*a*, an intermediate portion 13*b* and a sleeve portion 13*c*, in that order from the top-end side toward the rear-end side in the longitudinal direction. The intermediate portion 13*b* is a portion of the frame 13 with a predetermined width which includes a position W at which the lateral width of the frame 13 becomes maximum. The top portion 13*a* is a portion of the frame 13 which is closer to the top-end side than the intermediate portion 13*b*. The sleeve portion 13*c* is a portion of the frame 13 which ranges from the intermediate portion 13*b* to the position on the rear-end side at which the sleeve portion 13*c* is connected to the shaft 12. Each of the top portion 13*a*, the intermediate portion 13*b* and the sleeve portion 13*c* ranges approximately ⅓ the length of the frame 13 in the longitudinal direction of the frame 13 though not limited to a specific range.

A groove portion 17 is formed in the outer periphery of a portion of the frame 13 which extends from the top portion 13*a* to the center of the intermediate portion 13*b* in the longitudinal direction of the frame 13. The string 14 (not shown in FIG. 1B) is folded over at the bottom of the groove portion 17 to be threaded through the frame 13, which prevents the string 14 from coming in contact with the floor even when a portion of the frame 13 on the top-end side in the longitudinal direction thereof hits the floor.

Figure 2:
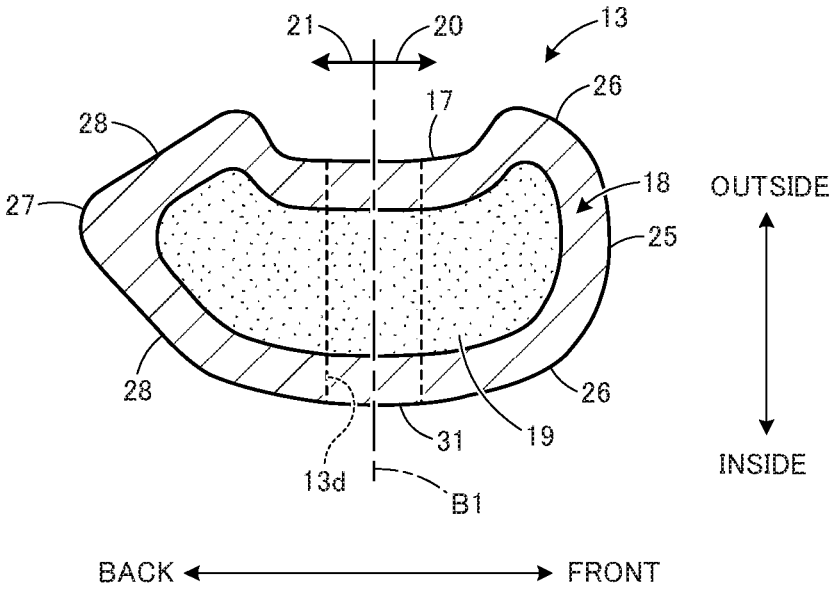
FIG. 2 is a schematic cross-sectional view for illustrating the frame shape, taken along the line A-A shown in FIG. 1A.
Figure 3:
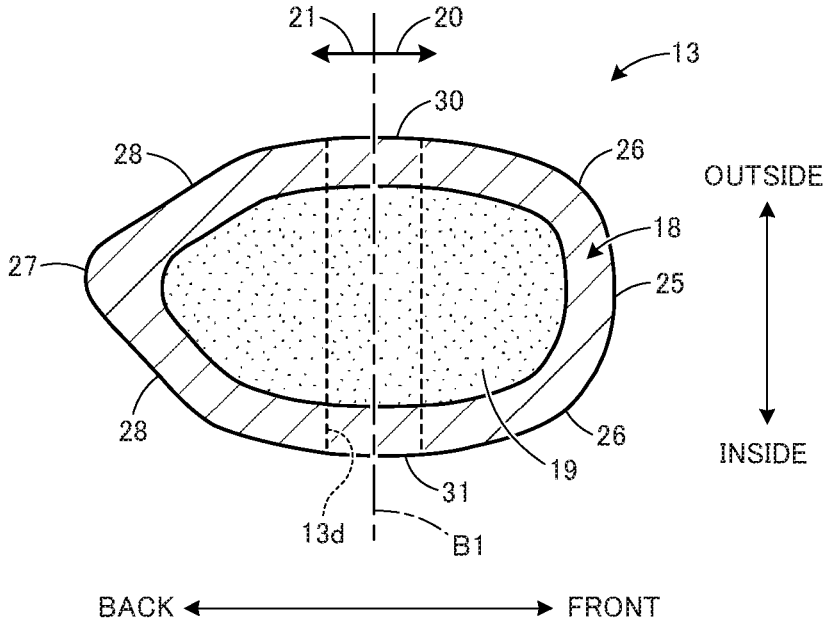
FIG. 3 is a schematic cross-sectional view for illustrating the frame shape, taken along the line B-B shown in FIG. 1A.

The cross sectional shape of the frame 13 will be hereinafter discussed with reference to FIGS. 2 and 3. FIG. 2 is a schematic cross-sectional view for illustrating the frame shape, taken along the line A-A shown in FIG. 1, and FIG. 3 is a schematic cross-sectional view for illustrating the frame shape, taken along the line B-B shown in FIG. 1. FIGS. 2 and 3 are cross sectional views each taken along a plane orthogonal to the direction of extension of the frame 13. As shown in FIGS. 2 and 3, the frame 13 is formed such that the inside of a hollow-tubular portion 18 thereof that has a predetermined wall thickness is filled with a predetermined forming material 19. This operation to fill the tubular portion 18 with the foaming material 19 can be omitted for part or the entire part of the frame 13. The material used as the forming material 19 can be, e.g., urethane-based or acrylic-based. The detailed structure of the inside of the wall thickness of the tubular portion 18 will be discussed later.

In the top portion 13*a* and the intermediate portion 13*b* of the frame 13 shown in FIG. 1, the frame 13 is formed to have the cross sectional shape shown in FIG. 2 or substantially the same cross sectional shape as that shown in FIG. 2, which is though slightly different in shape from that shown in FIG. 2, in the range in which the groove 17 is formed. Additionally, in the intermediate portion 13*b* and the sleeve portion 13*c* of the frame 13, the frame 13 is formed to have the cross sectional shape shown in FIG. 3 or substantially the same cross sectional shape as that shown in FIG. 3, which is though slightly different in shape from that shown in FIG. 3, in the range which extends toward the top-end side from the line B-B line and in which the groove 17 is not formed.

In the descriptions of the claims and the specification herein, when the position of the central axis of each insertion hole 13*d*, into which the string 14 (see FIG. 1A) is inserted, is defined as a boundary position B1, the outward-exposed surface of the frame 13 which is positioned on the front side of the frame 13 from the boundary position B1 is referred to as a front surface portion 20, unless otherwise noted; in addition, the outward-exposed surface of the frame 13 which is positioned on the back side of the frame 13 from the boundary position B1 is referred to as a back surface portion 21. Further, the vertical direction on the sheet of paper in each of FIGS. 2 and 3 is referred to as an outward/inward direction, and the upper side and the lower side in each of FIGS. 2 and 3 are referred to as the outer side and the inner side of the frame 13, respectively. The boundary position B1 can be changed within the thickness of the frame 13 as appropriate.

In the cross sectional views of FIGS. 2 and 3, the front surface portion 20 and the back surface portion 21 of the frame 13 are shaped asymmetrically. The term "asymmetrical" as used herein means that the front surface portion 20 and the back surface portion 21 do not become either symmetrical as the boundary position B1 is taken as an axis of symmetry or identical in shape to those when laterally reversed (front-back inverted) in FIGS. 2 and 3. The front surface portion 20 and the back surface portion 21 are mutually different in width in the frontward/backward direction; the back surface portion 21 is greater in width than the front surface portion 20.

The front surface portion 20 is shaped to have a flat surface portion 25 and curved surface portions 26 which are respectively continuous with both the outer and inner sides of the flat surface portion 25. The flat surface portion 25 is directed to extend substantially parallel to the outward/inward direction (the in-plane direction of the hitting surface 15) and shaped either to be flat, or so that a central portion of the flat surface portion 25 in the outward/inward direction slightly bulges. When the front surface portion 20 is equally divided into three areas in the outward/inward direction, the flat surface portion 25 is formed in the central area among the three areas. The curved surface portions 26 are each formed into a curved surface in the shape of a quartered-circular arc in a sectional view, and the end of each flat surface portion 25 on the opposite side from the flat surface portion 25 is directed toward the back side.

The back surface portion 21 is shaped to have a circular-arc surface portion 27, which is formed as a curved surface portion, and inclined surface portions 28 which are respectively continuous with both the outer and inner sides of the circular-arc surface portion 27. The circular-arc surface portion 27 has a curved surface in the shape of a quartered-circular arc in a sectional view which is formed so that a central portion of the circular-arc surface portion 27 in the outward/inward direction bulges most in the backward direction. The position at which the circular-arc surface portion 27 bulges most is set closer to the outer side than the midpoint of the frame 13 in the outward/inward direction. The inclined surface portions 28 are each formed substantially flat and extend in directions away from each other with respect to the direction toward the front side. The inclined surface portions 28, which are provided on the outer side and the inner side of the frame 13, extend in directions tangent to the outer-side end and the inner-side end of the circular-arc surface portion 27, respectively.

In the front surface portion 20 and the back surface portion 21 in the area having the cross section shown in FIG. 3, the peripheral surfaces of the frames 13 on both the outer side and the inner side thereof, which extend across the boundary line B1, are formed as bulging surfaces 30 and 31 which are smoothly curved and the centers of which in the frontward/backward direction bulge. The curvatures of the curved surface portions 26, the circular-arc surface portion 27 and the bulging surfaces 30 and 31 are set to increase in the order of the circular-arc surface portion 27, the curved surface portions 26, the bulging surface 30 and the bulging surface 31. In the area having the cross section shown in FIG. 2, the groove portion 17 is formed in the area corresponding to the outer-side bulging surface 30, and the outer-side bulging surface 31 shown in FIG. 2 and the outer-side bulging surface 31 shown in FIG. 3 are formed to be identical in shape.

According to the shapes described above, since the front surface portion 20 and the back surface portion 21 are shaped asymmetrically, the distribution of generated stress, the deformation amount of the cross sectional shape and the deformed shape thereof vary depending on whether the shuttlecock hits the front or back side of the hitting surface 15. In addition, it is possible to change second moment of area on deflection of the frame 13, etc. between the cases where the shuttlecock hits the front side of the hitting surface 15 and where the shuttlecock hits the back side of the hitting surface 15. This makes it possible to change, between the front and back sides of the hitting surface 15, the period of time in which the shuttlecock is in contact with the hitting surface 15, repulsion performance, etc. at the time of hitting the shuttlecock, thus making it possible to change performance properties of the racket on shuttlecock hitting such as shuttlecock hold and repulsion. This allows the player to make full use of two difference capabilities easily with the single racket 10, i.e., without changing the racket 10 to another, simply by changing his or her grip on the grip 11. Accordingly, the racket 10 can easily accommodate the player's preferences such as age, sex, skill level, etc.

From a further study of badminton play, in comparison between forehand and backhand, the shuttlecock speed tends to be high in the forehand stroke because the shuttlecock is quickly hit down on the court; accordingly, the swing speed tends to be high and the swing path tends to be long in the forehand stroke. In contrast, the swing path tends to be short in the backhand stroke, so that the player often hits back the shuttlecock so as to repel it toward an opponent's hard-to-hit point.

However, in the case where the front surface portion and the back surface portion of the frame are shaped symmetrically as in conventional badminton rackets, the frame itself cannot help but deliver the same performance even when required to create shots of different properties between forehand and backhand as noted above. Accordingly, there are problems that backhand performance deteriorates if the frame shape is designed to enhance forehand performance; and, on the contrary, that forehand performance deteriorates if the frame shape is designed to enhance backhand performance.

On this point, in the frame 13 of the present embodiment, it is possible to achieve different performance properties such as shuttlecock hold and repulsion between the front and back sides of the hitting surface 15, and it is possible to improve performance according to properties of both forehand and backhand as described above.

Additionally, the asymmetrical formation of the front surface portion 20 and the back surface portion 21 makes it possible to change air resistance in the frame 13 between forehand and backhand, so that it can also be expected thereby to achieve an improvement in performance according to properties of both forehand and backhand.

Figure 4:
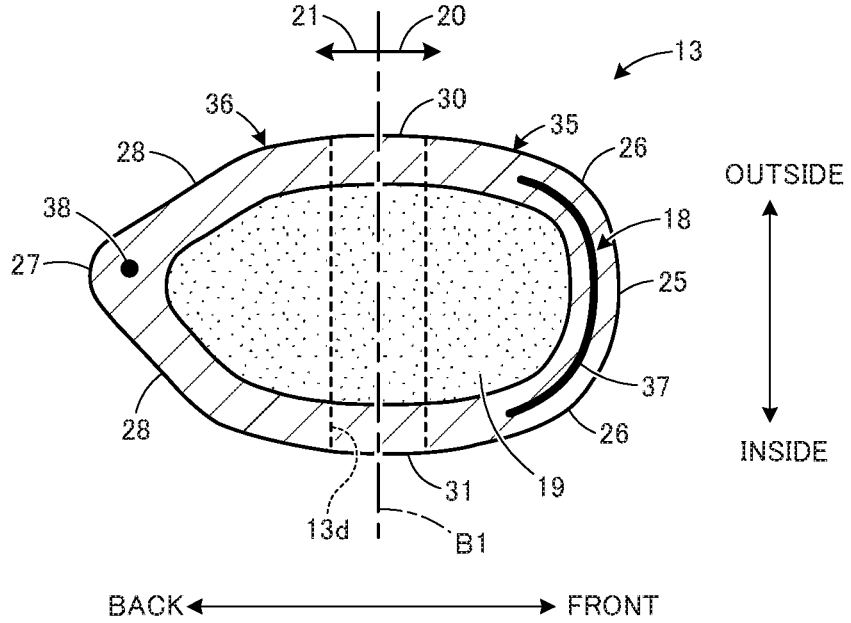
FIG. 4 is a schematic cross-sectional view for illustrating the materials of the frame, taken along the line B-B shown in FIG. 1A.

The material of the frame 13 will be hereinafter discussed with reference to FIG. 4. FIG. 4 is a cross-sectional view for illustrating the material of the frame, taken along the line B-B shown in FIG. 1. As shown in FIG. 4, the tubular portion 18 of the frame 13 disclosed herein consists of a front-surface forming body 35 and a back-surface forming body 36 which form the front surface portion 20 and the back surface portion 21, respectively. One of the front-surface forming body 35 and the back-surface forming body 36 is formed to include a deflection suppression portion 37 as a different material from the material of the other. In the present embodiment, the deflection suppression portion 37 is arranged as a layer accommodated within the thickness of the front-surface forming body 35 in the range corresponding to the flat surface portion 25 and the outer and inner curved surface portions 26.

A wire 38 is arranged in the back-surface forming body 36 at a position at which the circular-arc surface portion 27 bulges most. The wire 38 is for enhancing hardness and bending elastic modulus of the frame 13 and can be made of a titanium alloy, or made using a material such as titanium, stainless steel or boron.

In the formation of the tubular portion 18, a tube of resin sheets is formed and subsequently bent into an annular shape; thereafter, by setting this annular tube in a mold and thereafter heating and pressuring the same, this tube is formed into a shape along the mold. In the formation of the tube made of resin sheets, carbon prepreg sheets that mainly form the tubular portion 18 (fiber-reinforced plastic (FRP) in a prepreg state that is mainly composed of carbon fibers; hereinafter referred to as "main sheets") are multi-laminated and rolled into a cylindrical shape to form the tube. In this lamination forming, strip-shaped carbon prepreg sheets that form the deflection suppression portion 37 are interposed between the plurality of main sheets so that the deflection suppression portion 37 is arranged in the range corresponding to the flat surface portion 25 and the outer and inner curved surface portions 26 after molding. In addition, the wire 38 is interposed between the plurality of main sheets to be arranged in the area corresponding to the circular-arc surface portion 27 after molding. This causes the deflection suppression portion 37 to be formed within the thickness of the front-surface forming body 35 and causes the wire 38 to be arranged within the thickness of the back-surface forming body 36.

The carbon prepreg sheets that form the deflection suppression portion 37 become a molded body after molding, wherein the bending strength thereof is equal to or greater than 1800 MPa or equal to or smaller than 2000 MPa and wherein the bending elastic modulus thereof is equal to or greater than 155 GPa or equal to or smaller than 175 GPa. In the case where the number of carbon prepreg sheets that form the deflection suppression portion 37 is set more than one, these sheets can be either identical or mutually different in bending strength and bending elastic modulus as long as within the aforementioned range. In addition, after molding, the main sheets are formed into a molded body, wherein the bending strength thereof is equal to or greater than 1600 MPa or equal to or smaller than 1800 MPa and wherein the bending elastic modulus thereof is equal to or greater than 135 GPa or equal to or smaller than 155 GPa. The plurality of main sheets can be either identical or mutually different in bending strength and bending elastic modulus as long as within the aforementioned range.

In conventional badminton rackets in which two sides of the frame are identical in material, the frame itself cannot help but deliver the same performance even when required to create shots of different properties between forehand and backhand, similarly as described above. On this point, providing the frame 13 with the deflection suppression portion 37 and the wire 38 makes the frame 13 capable of changing the bending strength and bending elastic modulus thereof between the cases where the shuttlecock hits the front side of the hitting surface 15 and where the shuttlecock hits the back side of the hitting surface 15, which makes it possible to change the amount of deflection of the frame 13. Accordingly, this also makes it possible to change performance properties on shuttlecock hitting such as shuttlecock hold and repulsion between the front and back sides of the hitting surface. As a result, the player can easily present two difference capabilities with the single racket 10, i.e., without changing the racket 10 to another; moreover, it is possible to improve performance according to properties of both forehand and backhand.

Further, a combination of the shape of the frame 13 in which the front surface portion 20 and the back surface portion 21 are asymmetrical and the formation of the deflection suppression portion 37 makes it possible to synergistically increase the number of variations on shuttlecock hitting.

Figure 5:
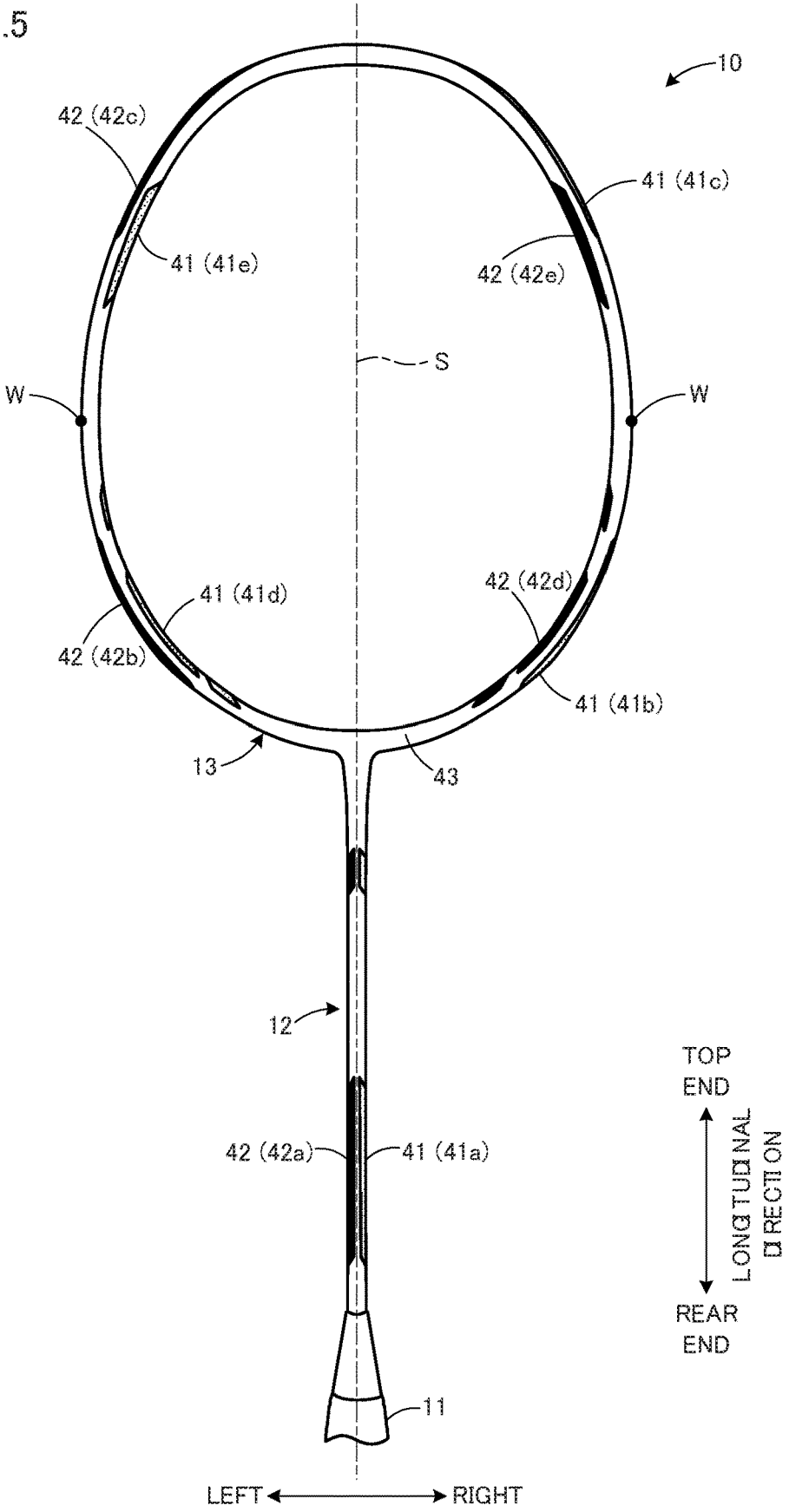
FIG. 5 is a back partial view for illustrating coloration of the racket.
Figure 6:
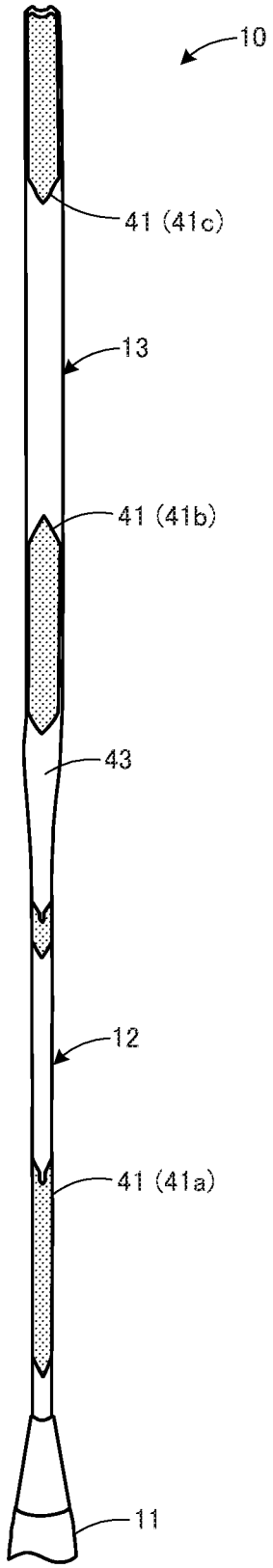
FIG. 6 is a side partial view for illustrating coloration of the racket.
Figure 7:
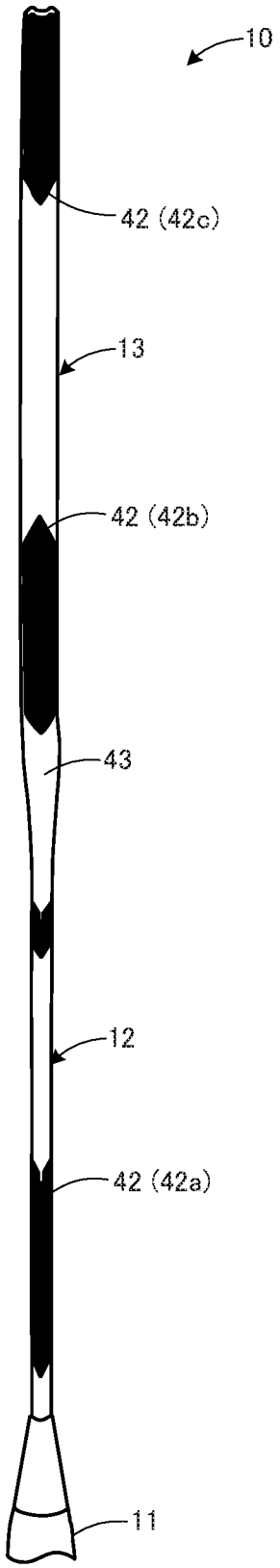
FIG. 7 is a side partial view showing the flip side of the racket shown in FIG. 6.
Figure 8:
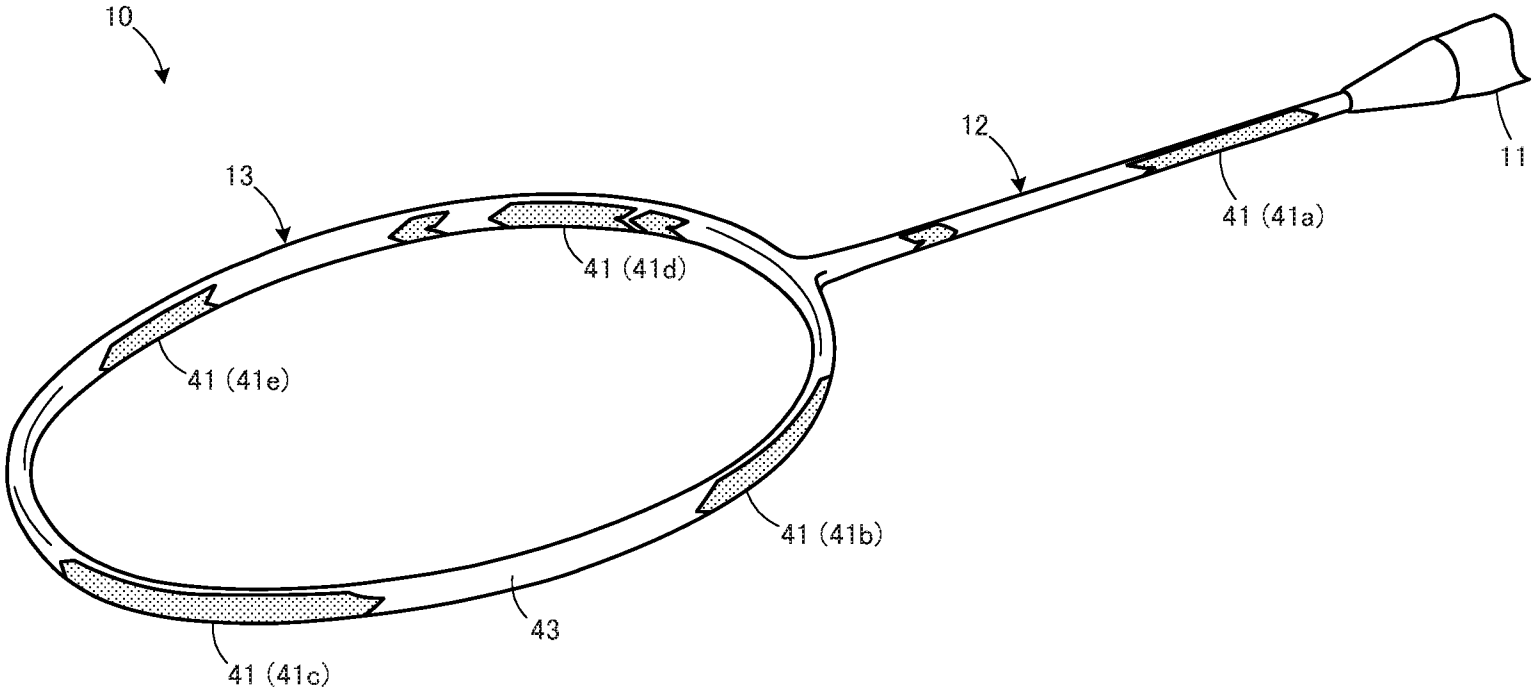
FIG. 8 is a partial perspective view for illustrating coloration of the racket.
Figure 9:
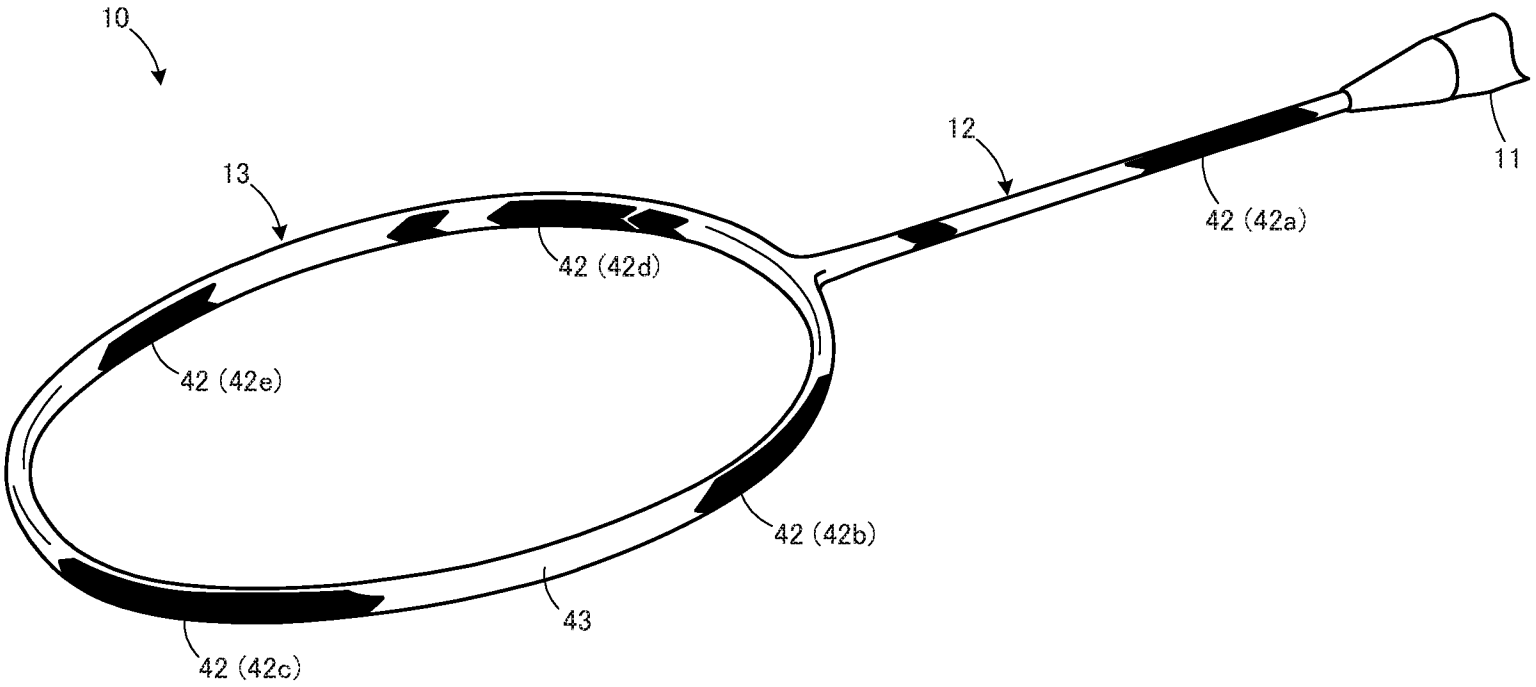
FIG. 9 is a partial perspective view showing the flip side of the racket shown in FIG. 8.

The coloration of the shaft 12 and the frame 13 will be hereinafter discussed with reference to FIGS. 5 through 9. FIGS. 5 through 9 are diagrams for illustrating the coloration of these parts; FIG. 5 is a back partial view of the racket, FIG. 6 is a side partial view of the racket, and FIG. 7 is a side partial view showing the flip side of the racket shown in FIG. 6. In addition, FIG. 8 is a partial perspective view, and FIG. 9 is a partial perspective view showing the flip side of the racket shown in FIG. 8.

In each of the shaft 12 and the frame 13, the surface is divided into different areas (portions) which are chiefly painted into three different colors: first colored portions 41, second colored portions 42 and a main colored portion 43. The main colored portion 43 occupies almost the entire surface area except for the areas of the first colored portions 41 and the second colored portions 42. Accordingly, the first colored portions 41 and the second colored portions 42 are also presented as designs or patterns on the shaft 12 and the frame 13. In FIGS. 5 through 9, dotted areas, black-painted areas and white-painted areas (the color of which is that of the sheet of paper) represent the first colored portions 41, the second colored portions 42 and the main colored portion 43, respectively, for the sake of illustration. In the actual coloration, the first colored portions 41, the second colored portions 42 and the main colored portion 43 only need to be mutually different in color; for instance, the first colored portions 41, the second colored portions 42 and the main colored portion 43 can be colored an orange-based color, a green-based color and a black-based color, respectively.

The first colored portions 41 are formed in five areas on the shaft 12 and the frame 13 in the present embodiment. When referred to as a 1-1 colored portion 41*a* through a 1-5 colored portion 41*e* for the sake of illustration, the five formation areas are as follows, as viewed from the back side of the racket 10 as shown in FIG. 5:

the 1-1 colored portion 41*a*: a right side surface of the shaft 12;

the 1-2 colored portion 41*b*: an outer-side surface closer to the rear than the position W on the right half of the frame 13;

the 1-3 colored portion 41*c*: an outer-side surface closer to the top than the position W on the right half of the frame 13;

the 1-4 colored portion 41*d*: an inner-side surface closer to the rear than the position W on the left half of the frame 13; and the 1-5 colored portion 41*e*: an inner-side surface closer to the top than the position W on the left half of the frame 13.

The 1-1 colored portion 41*a* is formed within an area which does not extend leftward beyond the center position of the shaft 12 in the leftward/rightward direction and fits on the right-hand side with respect to this center. In the present embodiment, the 1-1 colored portion 41*a* is formed discontinuously in separate areas close to the top end and the rear end of the shaft 12 and provided so that the main colored portion 43 appears between the separate areas of the 1-1 colored portion 41*a*. In addition, the portion of the 1-1 colored portion 41*a* which appears at a position close to the rear end is formed greater in length in the longitudinal direction than the other portion of the 1-1 colored portion 41*a*, which appears at a position close to the top end.

The 1-2 colored portion 41*b* and the 1-3 colored portion 41*c* are provided on the right half of the frame 13, i.e., on the right side of the frame 13, which corresponds to one of both sides of the shaft 12. The 1-2 colored portion 41*b* and the 1-3 colored portion 41*c* are formed within an area which does not extend inward beyond the center position of the frame 13 in the outward/inward direction and which fits on the outer side with respect to this center position. In the present embodiment, the 1-2 colored portion 41*b* and the 1-3 colored portion 41*c* extend in the extending direction of the frame 13 and are provided so that the main colored portion 43 appears therebetween. Further, the 1-2 colored portion 41*b* and the 1-3 colored portion 41*c* are provided so that the main colored portion 43 also appears between the rear end of the 1-2 colored portion 41*b* and the rearmost end of the frame 13 and between the top end of the 1-3 colored portion 41*c* and the topmost end of the frame 13.

The 1-4 colored portion 41*d* and the 1-5 colored portion 41*e* are formed within an area which does not extend outward beyond the center position of the frame 13 in the outward/inward direction and which fits on the inner side with respect to this center position. In the present embodiment, the 1-4 colored portion 41*d* and the 1-5 colored portion 41*e* extend in the extending direction of the frame 13 and are provided so that the main colored portion 43 appears therebetween. In addition, the 1-4 colored portion 41*d* is formed discontinuously in three separate areas and provided so that the main colored portion 43 appears between these separate areas and also appears between the rear end of the 1-4 colored portion 41*d* and the rearmost end of the frame 13. Further, the 1-4 colored portion 41*d* is formed so that the main colored portion 43 also appears between the top end of the 1-5 colored portion 41*e* and the topmost end of the frame 13.

The second colored portions 42 are formed in areas symmetrical to the first colored portions 41 with respect to a symmetrical axis S corresponding to the center position (shaft center position) of the shaft 12 in the leftward/rightward direction. Accordingly, the second colored portions 42 are also formed in five areas; when these five areas are referred to as a 2-1 colored portion 42*a* through a 2-5 colored portion 42*e* for the sake of illustration, the formation areas of the 2-1 colored portion 42*a* through the 2-5 colored portion 42*e* are formed to be symmetrical to the 1-1 colored portion 41*a* through the 1-5 colored portion 41*e*, respectively, with respect to the symmetrical axis S. In other words, flipping the racket 10 from the state shown in FIG. 1 causes the 2-1 colored portion 42*a* through the 2-5 colored portion 42*e* to be arranged in the areas in which the 1-1 colored portion 41*a* through the 1-5 colored portion 41*e* are previously arranged before the racket is flipped. On this account, the description about the formation areas of the 2-1 colored portion 42*a* through the 2-5 colored portion 42*e* is omitted herein.

As the racket 10 is viewed from a certain angle in a direction nonparallel and non-orthogonal to the hitting surface 15, e.g., as the racket 10 is viewed as shown in FIG. 8, the first colored portions 41 appear visible to the player in approximately half of the area of the shaft 12 and the frame 13. While the first colored portions 41 appear visible to the player in this manner, the main colored portion 43 appears visible to the player in the remaining half of the same area while the second colored portions are hidden from view. Therefore, the racket 10 appears to the player as a racket with the two colors of the first colored portions 41 and the main colored portion 43; at this time, the player can recognize that the lower and upper sides of the frame 13 and the hitting surface 15 on the sheet of paper of FIG. 8 correspond to the front and back sides of the racket 10, respectively.

On the other hand, flipping the racket 10 (the hitting surface; not shown in FIG. 8) through 180 degrees on the axis of the shaft 12 by the player changing his or her grip on the grip 11 from the state shown in FIG. 8 causes the racket 10 to move to the state shown in FIG. 9. At this time, while the second colored portions 42 appear visible to the player in approximately half of the area of the shaft 12 and the frame 13, the main colored portion 43 appears visible to the player in the remaining half of the same area while the first colored portions are hidden from view. Therefore, the racket 10 appears to the player as a racket with the two colors of the second colored portions 42 and the main colored portion 43; at this time, the player can recognize that the lower and upper sides of the frame 13 and the hitting surface 15 on the sheet of paper of FIG. 9 correspond to the back side and the front side of the racket 10, respectively.

Rotating the racket 10 through ±90 degrees about the symmetrical axis S from the state shown in FIG. 5 causes the racket to move to the states shown in FIGS. 6 and 7, respectively, thus causing either one of the first colored portions 41 or the second colored portion 42 to be hidden from view. It is desirable that the angle at which either one of the first colored portions 41 or the second colored portion 42 is hidden from view be in the range of ±20 degrees about the symmetrical axis S from the state shown in FIGS. 6 and 7.

The first colored portions 41 and the second colored portions 42 that are shown in FIGS. 5 through 9 are shown by way of mere example; various modifications are possible so long as the player can distinguish between the front and back sides of the hitting surface 15 as described above. For instance, in regard to the above described five formation areas of each set of the first colored portions 41 and the second colored portions 42, at least one formation area only needs to be provided for each set of the first and second colored portions 41 and 42; in addition, the shape of the colored portion in each set of the first colored portions 41 and the second colored portions 42 is not limited to the illustrated embodiment shown in the drawings. Additionally, for instance, the 1-2 colored portion 41*b* and the 1-3 colored portion 41*c* can be formed to be connected to each other, and the 1-4 colored portion 41*d* and the 1-5 colored portion 41*e* can be formed to be connected to each other.

Further, the color or each of the first colored portion 41 and the second colored portion 42 can either be monochrome or consist of a plurality of analogous colors to appear like a design or a pattern. In addition, when the first colored portions 41 and the second colored portions 42 are hidden from view as the player view from a certain angle, these portions do not necessarily need to be fully hidden from view; a design partially comes into view intentionally can also be adopted. Additionally, in each colored portion 41 through 43, it is not precluded to apply letters/characters, markings, logotypes, designs, patters, etc. In addition, when using grommets, the grommets in each colored portion 41 through 43 on the frame 13 can be colored.

As described above, since the racket 10 is provided with each colored portion 41 through 43, the player can easily distinguish between the front and back sides of the hitting surface 15 depending on whether the first colored portions 41 or the second colored portions 42 is visible, which makes it possible to easily determine as to whether either the front or back sides of the hitting surface 15 should be selected to hit the shuttlecock. Accordingly, in the case where the front and back sides of the hitting surface 15 are mutually different in performance property on shuttlecock hitting (shuttlecock hold and repulsive) as described above, the player can easily selectively use the different capabilities during play or a rally.

Additionally, the design appearance of the racket 10 can be greatly changed between the state shown in FIG. 8 and the state shown in FIG. 9, which allows the single racket 10 to easily present two different types of design appearances. This makes it possible to greatly change the appearance or impression of the racket 10 as viewed from the player's side, thus making it possible for the racket 10 to accommodate the player's preferences for design even if they vary. The appearance of the racket 10 from the player's side changes depending also on which hand (left or right hand) holds the racket 10.

Figure 10A:
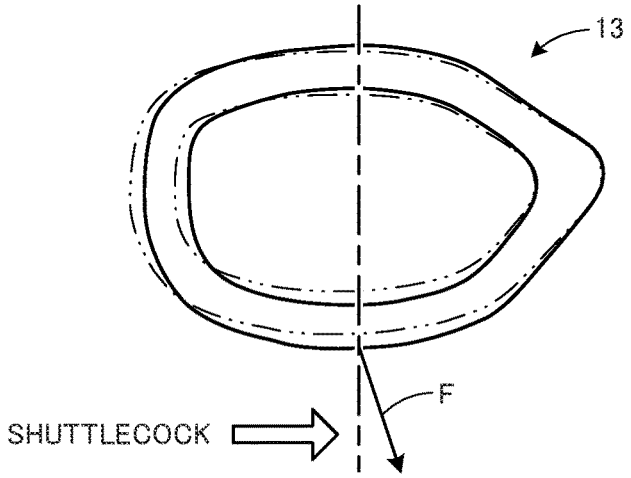
FIGS. 10A and 10B are cross sectional views of a frame according to Embodiment 1 and FIG. 10C is a cross sectional view of a frame of a comparative example.
Figure 10B:
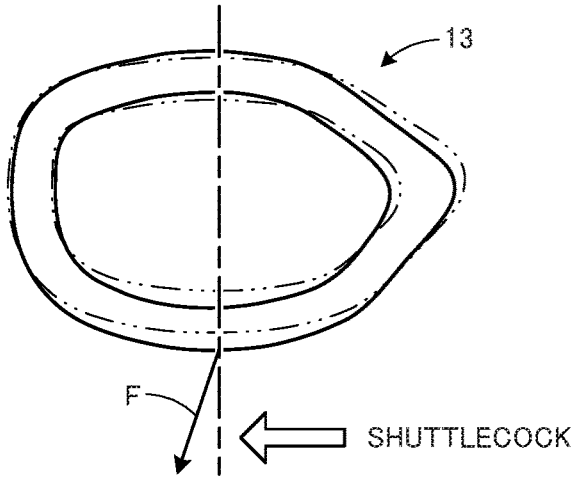
Figure 10C:
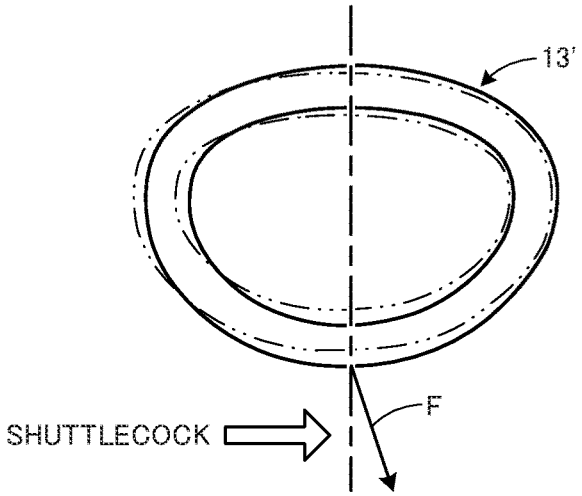

Next, the analyses (simulations) which were performed to evaluate the shuttlecock hold and repulsion of the racket according to the above described embodiment will be hereinafter discussed with reference to FIG. 10. FIGS. 10A and 10B are cross sectional views of a frame according to Embodiment 1 and FIG. 10C is a cross sectional view of a frame according to a comparative example. In these analyses, the racket of Embodiment 1 has the same shape as the racket illustrated in the above described embodiment and is provided with the frame 13 which has the cross sectional shape shown by two-dot chain lines in FIGS. 10A and 10B. However, the deflection suppression portion 37 and the wire 38 (see FIG. 4) are not used as materials of the racket of Embodiment 1; the frame 13 is molded from the main sheets noted above. The racket of the comparative example is identical in configuration and condition to that of Embodiment 1 except that a frame 13' of the racket of the comparative example has the modified cross sectional shape shown by two-dot chain lines in FIG. 10C. The frame 13' of the comparative example has a front-back symmetrical shape similar to an elliptical shape in a cross sectional view and is shaped as if only the upper half of an ellipse were squashed so as to reduce the width in the vertical direction of FIG. 10C.

The sectional displacement and stress distribution of the each frame 13 and 13' at the time of hitting the shuttlecock were analyzed using the racket of Embodiment 1 and the racket of the comparative example. In the simulation of the sectional displacement, the cross sectional shape when a load F is applied to the sweet spot of the hitting surface was determined on the assumption that a shuttlecock hits the sweet spot of the hitting surface at a predetermined relative speed. In the racket of Example 1, a simulation for the case where a shuttlecock is hit with the front side of the hitting surface, i.e., with the left half with respect to FIG. 10A and a simulation for the case where a shuttlecock is hit with the back side of the hitting surface, i.e., with the right half with respect to FIG. 10B were both performed. In the racket of the comparative example, a simulation for the case where a shuttlecock is hit with the left half with respect to FIG. 10C that corresponds to a half of the hitting surface was performed. In FIGS. 10A through 10C, the results of the simulations for the cross sectional shape when the displacement becomes maximum upon a shuttlecock being hit in the respective cases are shown by solid lines, and the relative values of the maximum displacement in Example 1 are shown in Table 1 below, in which the maximum displacement in the comparative example is defined as 100.

In addition, stress distribution when the shuttlecock is hit in the same manner is also determined on each frames 13 and 13' to determine the maximum stress, at which the stress becomes maximum. The relative values of the maximum stress in Example 1 are shown in Table 1 below, in which the maximum stress in the comparative example is assumed to be 100.

TABLE 1

| | | EMBODIMENT 1 | |
|---|---|---|---|
| | COMPARATIVE EXAMPLE | HITTING SHUTTLECOCK WITH FRONT SIDE | HITTING SHUTTLECOCK WITH BACK SIDE |
| MAXIMUM DISPLACEMENT | 100 | 117 | 95 |
| MAXIMUM STRESS | 100 | 120 | 95 |

As can be seen from the results shown in Table 1, the maximum stress and also the maximum displacement are greater when the shuttlecock is hit with the front side than those when the shuttlecock is hit with the back side. This makes the player feel the difference in performance on shuttlecock hold and repulsion between the front side and back side of the hitting surface.

Figure 11:
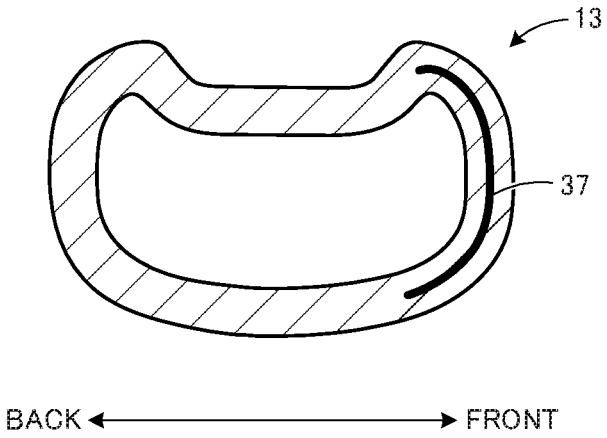
FIG. 11 is a cross sectional view of a frame according to Embodiment 2.

Next, the experiment which was performed to evaluate the deflection performance of the racket according to the above described embodiment will be discussed hereinafter. For the preparation of this experiment, a racket with a frame having the cross sectional shape shown in FIG. 11 was prepared as Embodiment 2. FIG. 11 is a cross sectional view of the frame according to Embodiment 2. The frame 13 of Embodiment 2 has a front-back symmetrical shape, and both the front and back thereof were each formed to be identical in shape to the front surface portion 20 (see FIG. 2) of the above illustrated embodiment. In addition, the frame 13 of Embodiment 2 was configured to include the deflection suppression portion 37 described above but molded without using the wire 38 and the foaming material 19. Additionally, in the deflection suppression portion 37, the bending strength was set to be equal to or greater than 1800 MPa or equal to or smaller than the 2000 MPa and the bending elastic modulus was set equal to or greater than 155 GPa or equal to or smaller than 175 GPa, whereas in the portion other than the deflection suppression portion 37 which is formed of the main sheets, the bending strength was set to be equal to or greater than 1600 MPa or equal to or smaller than the 1800 MPa and the bending elastic modulus was set equal to or greater than 135 GPa or equal to or smaller than 155 GPa.

Figure 12A:
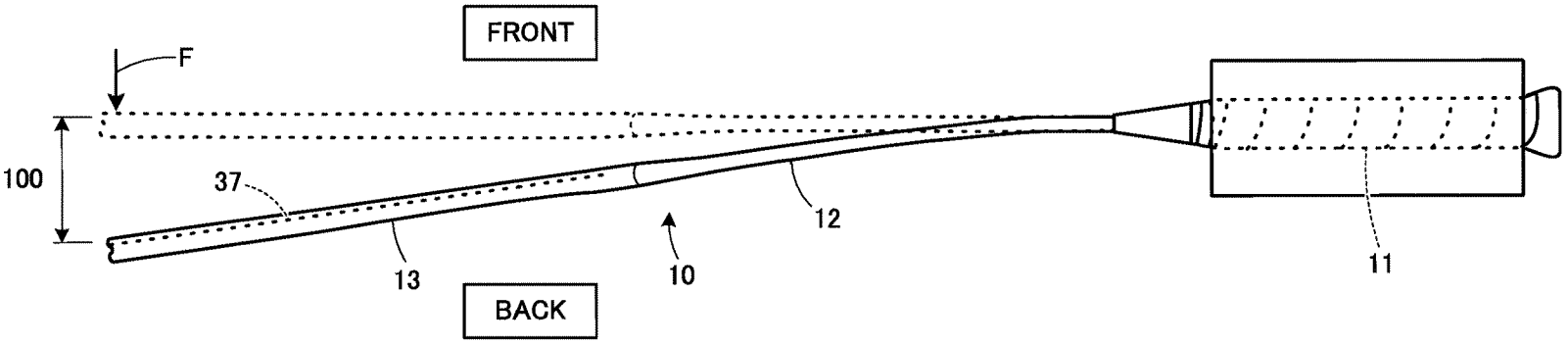
FIGS. 12A and 12B show illustrations of an experiment for measurement of the amount of deflection of the racket of Embodiment 2.
Figure 12B:
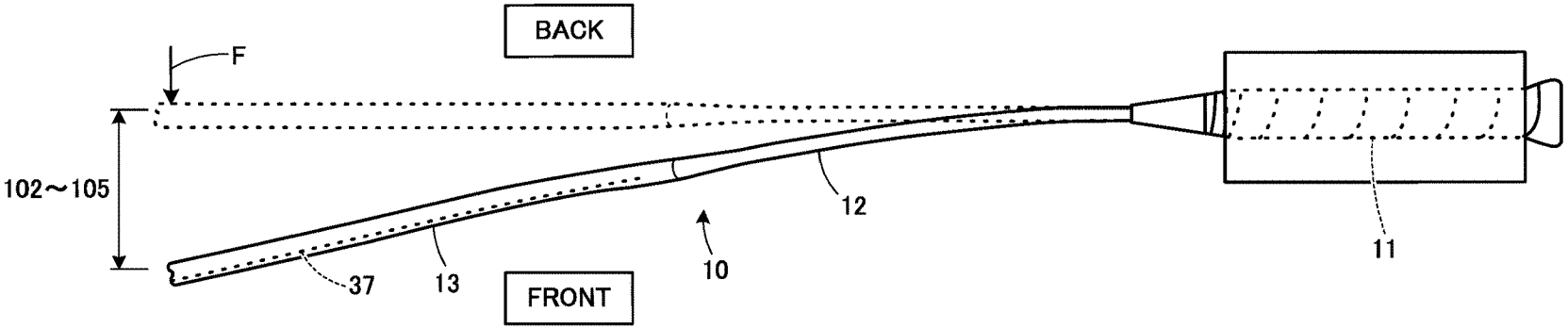

FIG. 12 shows illustrations of the experiment for measurement of the amount of deflection of the racket of Embodiment 2. As shown in FIG. 12, in this experiment, the grip 11 of the racket 10 was fixed, a predetermined load F was applied to the top end of the frame 13, and the amount of deformation of the racket in the frontward/backward direction at the top end of the frame 13 with respect to the position prior to the application of the load F was measured as the amount of deflection. This measurement was performed for both cases where the load F was applied from the front side and the back side of the frame 13. In this measurement, the relative value of the deflection amount when the load F was applied from the back side was 102 to 105 (see FIG. 12B) in the case of the value of the deflection amount being defined as 100 when the load F was applied from the front side (see FIG. 12A).

As can be seen from the above measurement results, the arrangement of the deflection suppression portion 37 on the side (shuttlecock hitting side) to which the load F is applied makes the deflection amount smaller than that in the case where the deflection suppression portion 37 is arranged on the opposite side. Therefore, hitting the shuttlecock with the front side rather than the back side makes it possible to achieve improvements in power and shuttlecock hold by smashing the shuttlecock through the action of the deflection suppression portion 37.

The present invention is not limited to the above described embodiments; the present invention can be practiced with various modifications. In the above described embodiments, the size, shape, direction, etc. illustrated in the attached drawings are not limited thereto and can be modified as required within the scope of the invention. Additionally, the present invention can be practiced with modifications as required without departing from the scope of the objective of the invention.

For instance, the distinction between the front and back of the racket 10 can be made reverse to that in the above illustrated embodiment, and one side of the racket only has to be made as the front side and the opposite side as the back side.

In addition, the shape of a cross section of the frame 13 taken along a plane orthogonal to the direction of extension of the frame 13 can be modified so long as the front surface portion 20 and the back surface portion 21 become asymmetrical in shape. For instance, in a cross-sectional view, the frame 13 can be provided with a plurality of protrusions which protrude in the frontward/backward direction and/or a depressed portion(s).

Additionally, the formation position, the formation range and the number of installations of the deflection suppression portion 37 are not limited to those in the configuration shown in FIG. 4; various modifications are possible. For instance, the deflection suppression portion 37 can be divided and provided separately in the outward/inward direction, or can be provided solely in the flat surface portion 25, not in the curved surface portions 26, or provided as a plurality of layers layered in the wall thickness direction of the cylindrical portion 18.

Additionally, the deflection suppression portion 37 and the wire 38 can be provided continuously over the length of the frame 13 in the direction of extension thereof or partially in the same extension direction.

Additionally, in the frame 13, the deflection suppression portion 37 and the wire 38 can be omitted; in this case, each of the front-surface forming body 35 and the back-surface forming body 36 can be formed of the same material. Further, unlike the design with each colored portion 41 through 43, a design with no coloration is also possible.

INDUSTRIAL APPLICABILITY

The present invention relates to a badminton racket capable of easily achieving different performance properties on both sides of the hitting surface.

The present application is based on Japanese patent application No. 2015-114811, filed on Jun. 5, 2015. The subject manner thereof is incorporated herein by reference in its entirety.

The invention claimed is:

1. A badminton racket comprising:

a frame which extends annularly, a grip, a shaft which connects said frame and said grip to each other, and a string which is stretched across said frame to form a hitting surface on both sides of said frame, said frame is formed to make a front surface portion and a back surface portion thereof asymmetrical in shape in a cross sectional view taken along a plane orthogonal to an extension direction of said frame;

wherein at least one of said frame and said shaft comprises a first colored portion and a second colored portion for distinguishing between front and back sides of said hitting surface, and wherein, as said badminton racket is viewed from a certain angle in a direction nonparallel and non-orthogonal to said hitting surface, said first colored portion appears visible while said second colored portion is hidden from view, and flipping said hitting surface from this state causes said second colored portion to appear visible and causes said first colored portion to be hidden from view.

2. The badminton racket according to claim 1, wherein a through-hole into which said string is inserted is formed in said frame, and wherein said front surface portion and said back surface portion are mutually different in protruding amount in a frontward/backward direction with respect to a position of a central axis of said insertion hole.

3. The badminton racket according to claim 1, wherein one of said front surface portion and said back surface portion comprises a flat surface portion substantially parallel to an in-plane direction of said hitting surface, and wherein the other of said front surface portion and said back surface portion comprises a curved surface portion which bulges in a frontward/backward direction.

4. The badminton racket according to claim 1, wherein said frame comprises a front-surface forming body which forms said front surface portion and a back-surface forming body which forms said back surface portion, and wherein one of said front-surface forming body and said back-surface forming body is formed to include a material different from a material of the other of said front-surface forming body and said back-surface forming body.

5. The badminton racket according to claim 2, wherein one of said front surface portion and said back surface portion comprises a flat surface portion substantially parallel to an in-plane direction of said hitting surface, and wherein the other of said front surface portion and said back surface portion comprises a curved surface portion which bulges in a frontward/backward direction.

6. The badminton racket according to claim 5, wherein said frame comprises a front-surface forming body which forms said front surface portion and a back-surface forming body which forms said back surface portion, and wherein one of said front-surface forming body and said back-surface forming body is formed to include a material different from a material of the other of said front-surface forming body and said back-surface forming body.

7. A badminton racket comprising:

a frame which extends annularly, a grip, a shaft which connects said frame and said grip to each other, and a string which is stretched across said frame to form a hitting surface on both sides of said frame, said frame is formed to make a front surface portion and a back surface portion thereof asymmetrical in shape in a cross sectional view taken along a plane orthogonal to an extension direction of said frame;

wherein a through-hole into which said string is inserted is formed in said frame, and wherein said front surface portion and said back surface portion are mutually different in protruding amount in a frontward/backward direction with respect to a position of a central axis of said insertion hole, wherein said frame comprises a front-surface forming body which forms said front surface portion and a back-surface forming body which forms said back surface portion, and wherein one of said front-surface forming body and said back-surface forming body is formed to include a material different from a material of the other of said front-surface forming body and said back-surface forming body.

8. The badminton racket according to claim 7, wherein at least one of said frame and said shaft comprises a first colored portion and a second colored portion for distinguishing between front and back sides of said hitting surface, and wherein, as said badminton racket is viewed from a certain angle in a direction nonparallel and non-orthogonal to said hitting surface, said first colored portion appears visible while said second colored portion is hidden from view, and flipping said hitting surface from this state causes said second colored portion to appear visible and causes said first colored portion to be hidden from view.

9. A badminton racket comprising:

a frame which extends annularly, a grip, a shaft which connects said frame and said grip to each other, and a string which is stretched across said frame to form a hitting surface on both sides of said frame, said frame is formed to make a front surface portion and a back surface portion thereof asymmetrical in shape in a cross sectional view taken along a plane orthogonal to an extension direction of said frame;

wherein one of said front surface portion and said back surface portion comprises a flat surface portion substantially parallel to an in-plane direction of said hitting surface, and wherein the other of said front surface portion and said back surface portion comprises a curved surface portion which bulges in a frontward/backward direction, wherein said frame comprises a front-surface forming body which forms said front surface portion and a back-surface forming body which forms said back surface portion, and wherein one of said front-surface forming body and said back-surface forming body is formed to include a material different from a material of the other of said front-surface forming body and said back-surface forming body.

10. The badminton racket according to claim 9, wherein at least one of said frame and said shaft comprises a first colored portion and a second colored portion for distinguishing between front and back sides of said hitting surface, and wherein, as said badminton racket is viewed from a certain angle in a direction nonparallel and non-orthogonal to said hitting surface, said first colored portion appears visible while said second colored portion is hidden from view, and flipping said hitting surface from this state causes said second colored portion to appear visible and causes said first colored portion to be hidden from view.

* * * * *